US005545109A

United States Patent [19]

Hayakawa

[11] Patent Number: 5,545,109

[45] **Date of Patent: * Aug. 13, 1996**

[54] TORQUE LIMITER

[76] Inventor: Toshio Hayakawa, 1-go, 50-ban, Yamanoue 5-chome, Hirakata-shi, Osaka-fu, Japan

[ * ] Notice: The term of this patent shall not extend beyond the expiration date of Pat. No. 5,339,869.

[21] Appl. No.: 248,976

[22] Filed: May 25, 1994

Related U.S. Application Data

[63] Continuation-in-part of Ser. No. 880,846, May 11, 1992, Pat. No. 5,339,869.

[30] Foreign Application Priority Data

May 11, 1991 [JP] Japan ..... 3-167356

[51] Int. Cl.[6] ..... F16D 7/08

[52] U.S. Cl. ..... 477/178; 192/56.54; 192/150

[58] Field of Search ..... 192/56 R, 150, 192/56.33, 56.43, 56.54, 56.57, 56.62; 477/178; 464/36

[56] References Cited

U.S. PATENT DOCUMENTS

| | | | |
|---|---|---|---|
| 1,883,164 | 10/1932 | Vassakos | 192/150 |
| 3,405,789 | 10/1968 | Orwin et al. | 192/56 R |
| 3,608,686 | 9/1971 | Martin, Sr. | 192/150 |
| 3,893,553 | 7/1975 | Hansen | 192/56 R |
| 4,208,555 | 6/1980 | Ikeda et al. | 192/150 X |
| 4,231,270 | 11/1980 | Totsu | 192/150 X |
| 4,255,946 | 3/1981 | Hansen | 192/56 X |
| 5,339,869 | 8/1994 | Hayakawa | 140/119 |

*Primary Examiner*—Richard M. Lorence
*Attorney, Agent, or Firm*—Edwin E. Greigg; Ronald E. Greigg

[57] ABSTRACT

In a torque limiter, a ball pressing mechanism is provided to press a ball by a spring into a round hole having a smaller diameter than the ball formed at the end surface of an input member of the torque limiter main body. Accordingly, it is designed to actuate accurately when the load torque exceeds a specific value. Furthermore, the constitution includes rotation limiting means for limiting the relative rotational angle of the input member and output member within a specific angle after the torque limiter main body is put in action, and positioning mechanism for positioning the output member in cooperation with the action of the torque limiter. Hence, the output member can be positioned accurately.

7 Claims, 14 Drawing Sheets

TORQUE LIMITER

This application is a continuation-in-part of application Ser. No. 07/880,846 filed May 11, 1992, now U.S. Pat. No. 5,339,869.

FIELD OF THE INVENTION

The present invention relates to a torque limiter, and more particularly to a torque limiter capable of positioning and stopping an output member cooperating with a load securely at a specific position.

BACKGROUND OF THE INVENTION

A torque limiter generally comprises an input member 131*a* for entering a driving force, and an output shaft 131*h*, for example, as shown in FIG. 18, and when the load torque that the output shaft 131*h* receives a specific value, it is so designed that the output shaft 131*h* may rotate coaxially with the input member 131*a*.

In this prior art, a shake-proof washer 131*b* is formed at an end surface of the input member 131*a*, and a ball 131*d* held in a ball holding plate 131*c* formed integrally with an output shaft 131*h* is pressed to the shake-proof washer 131*b* with a spring 131*f*.

As shown in FIG. 18(*b*), while the ball 131*d* is pushed into the bottom of the shake-proof washer 131*b*, the shake-proof washer 131*d* drives the ball 131*d* in the rotating direction of the input member 131*a*, and the torque of the input member 131*a* is transmitted to the ball holding plate 131*c* holding the ball 131*d* and to the output shaft 131*h*.

When the load is applied to the output shaft 131*h*, the ball 131*d* is driven by the load in a reverse direction of the rotating direction of the input member 131*a*, and moves along the ridge of the shake-proof washer 131*b*. The moving of the ball 131*d* along the ridge is suppressed by the pressure of the spring 131*f*, and as shown in FIG. 18(*c*), the ball 131*d* is further moved by the load to the ridge of the shake-proof washer 131*b*, when the transmission of torque from the input member 131*a* to the output shaft 131*h* is cut off, thereby preventing generation of overload.

After interruption of the torque transmission, it is free whether or not to continue to drive the input member 131*a*, but usually driving of the input member 131*a* is stopped so as not to consume the energy wastefully.

In such a constitution, when it is demanded that the output shaft 131*h* should be stopped at a specific rotating position, a positioning mechanism 133 as shown in FIG. 19 is provided. The positioning mechanism possesses a positioning groove 133*b* at one point of the peripheral edge, and further comprises a rotary plate 133*a* coupled with the input member 131*a* and a pawl 133*c* pressed to the peripheral surface of the rotary plate 133*a* by a spring 133*d*, and by fitting the pawl 133*c* into the groove 133*b*, the stopping position of the output shaft 131*h* is determined, and when starting up, by pulling out the pawl 133*b* from the groove 133*b* by an actuator not shown through, for example, a lever 142' by overcoming the spring 133*d*, the positioning action is cleared.

According to the positioning mechanism 133, first, when the pawl 133*c* is pulled out of the groove 133*b* by resisting the spring 133*d*, the positioning action is cleared. Then, when the output shaft 131*h* is rotated to actuate the torque limiter (or by the manipulation of the operator before the torque limiter is actuated), the action of the actuator is stopped, and the pawl 133*c* is pressed against the periphery of the rotary plate 133*a* by the spring 133*d*. Afterwards, the output shaft 131*h* rotates, the pawl 133*d* fits into the groove 133*b*, and the output shaft 131*h* is positioned and stopped.

As a result, the load torque applied to the torque limiter through the rotary plate 133*a* exceeds a specific value and the torque transmission is cut off by the torque limiter, thereby preventing the motor from being overloaded. By the position of the pawl 133*c* and the rotation phase of the rotary plate 133*a*, when it is detected that the roller stops at a specific position, the motor is stopped.

It is also possible to actuate the positioning means after starting the torque limiter. That is, after the torque limiter is put in action, it is designed to have the pawl 133*c* engaged in the groove of the rotary plate 133*h* which rotates by inertia.

According to the conventional constitution, as shown in FIG. 17(*a*), when the ball 131*d* pushed into the bottom of the shake-proof washer 131*b* rides over the top of the shake-proof washer 131*b*, the torque applied to the input member 131*a* increases gradually. When the torque applied to the output shaft 131*h* is larger than the torque shown in FIG. 17(*a*), the torque limiter is actuated and hence no problem occurs, but as explained later, when the output of the output shaft 131*h* is used in twisting a wire rod, the load torque applied to the output shaft 131*h* increases slowly depending on the twisting amount of the wire rod as shown in FIG. 17(*b*). In this case, the actuating position of the torque limiter (the rotating position: B-C in FIG. 17(*a*)) becomes unstable, and the torque limiter often fails to act at an expected position.

Furthermore, in the conventional positioning mechanism, to actuate the torque limiter by causing the pawl 133*a* to engage with the groove 133*b* by force before actuation of the torque limiter, the output shaft 131*h* stops, by the manipulation of the operator, regardless of the load side torque.

However, as explained below, when the twisting torque of the wire rod is demanded to be more than a specific value in the case of, for example, using the torque limiter in twisting of wire rod, the constitution for stopping the output shaft 131*h* by the operator as described above is useless.

Yet, in the constitution for positioning the output shaft which rotates by inertia after actuation of the torque limiter, a flywheel and others are needed for keeping the inertia of the output shaft 131*h*, which results in a larger size.

The invention is hence proposed in the light of the conventional circumstances as stated above, and it is an object thereof to present a torque limiter which acts accurately depending on the load torque.

It is another object to present a torque limiter provided with a positioning mechanism in a simple constitution.

It is a further object to present a torque limiter provided with a positioning mechanism capable of stopping at an accurate position.

SUMMARY OF THE INVENTION

To achieve the objects, the invention comprises the following means.

That is, as shown in FIG. 1, the invention presents a torque limiter comprising an input member 311 for entering a driving force, and an output member which rotates in cooperation with the input member and receives a load, for cutting off torque transmission between the-input member 311 and the output member when the load torque exceeds a specific value, wherein a ball pressing mechanism is provided for pressing a ball 313*a* with a spring 333 into a circular hole 311*c* having a smaller diameter than the ball 314 formed at an end surface of the input member 311 of the torque limiter main body 31.

In this constitution, as shown in FIG. 15, the transmission torque of the input member 31 drops suddenly depending on the moving distance of the ball 314, so that the actuation position is stable.

The constitution further comprises rotation limiting means 319 for limiting a relative rotational angle of the input member 311 and output member after actuation of the torque limiter main body 31 below a specific angle, and a positioning mechanism 33 for positioning the output member which rotates with an angle delay defined by the rotation limiting means 319 after actuation of the torque limiter main body 31.

According to the rotation limiting means 319, since the relative rotational angle of the input member 311 and output member 313 is limited below a specific angle after actuation of the torque limiter, after the torque limiting action of the torque limiter 31 has begun, the rotation of the output member 313 once stops the same as in the prior art, but when the input member 311 rotates over a specific angle relative to the output member 313, the relative rotation of the input member 311 and output member 313 is limited, and the output member 313 rotates again together with the input member 311.

Afterwards, the positioning mechanism stops the output member 313 at a specific rotational angle.

Therefore, the output member 313 does not stop immediately after actuation of the torque limiter, but the output member 313 always stops once it arrives at a specific rotational angle position.

The rotation limiting means 319 comprises rotating limiting pins 319*a* planted on the input member 311, and a ball holding plate 312 which rotates in cooperation with the output member, which holds a ball 314 on the input member, and has plural arc-shaped holes 319*b* in which the rotation limiting pins 319*a* are inserted movably within a specific angle in the peripheral direction.

The positioning mechanism 33 comprises a rotary plate 331 coupled to the output member of the torque limiter main body 31 and forms a positioning groove 331 on the periphery, and a pawl 334 bites into the groove 332 when pressed to the peripheral surface of the rotary plate 331 by a spring 333.

By the constitution of the positioning mechanism 33, the rotary plate 331 of the positioning mechanism 33 is driven to a rotation phase in which the groove 332 formed on the periphery confronts the pawl 334, and the pawl 334 is engaged with the groove 332, and thereby positioning is achieved.

The positioning mechanism possesses clearing means for disengaging the pawl 334 biting into the groove 332 from the groove 332 by resisting the spring 333.

The torque limiter also comprises driving stopping means for stopping driving of the input member 311 when the positioning mechanism 33 is actuated. In this constitution, the input member 31 is stopped immediately after positioning, and excessive load applied to the input member 311 by positioning is alleviated.

Embodiments

Figure 1:
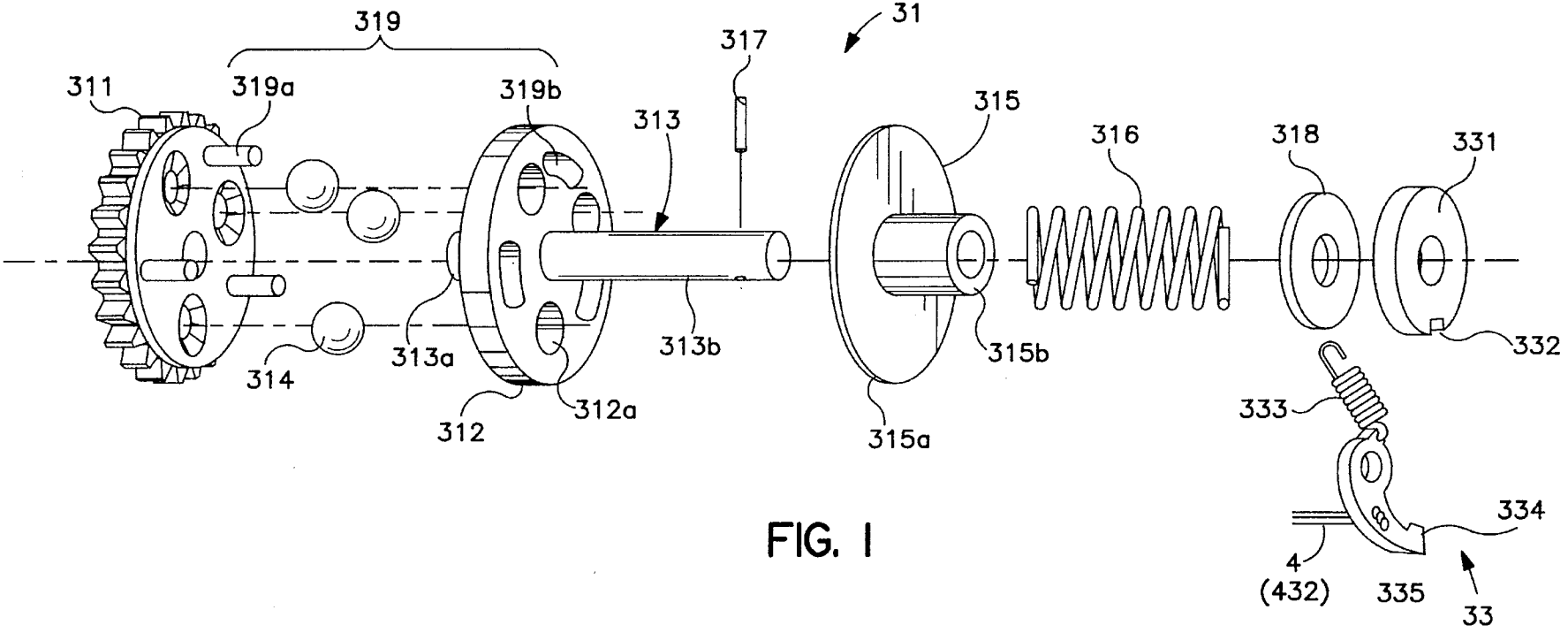
FIG. 1 is a perspective view showing the constitution of the invention.

Referring now to the drawings, an embodiment of the invention in a twisted wire bundling machine using a torque limiter is described in detail below.

Figure 2:
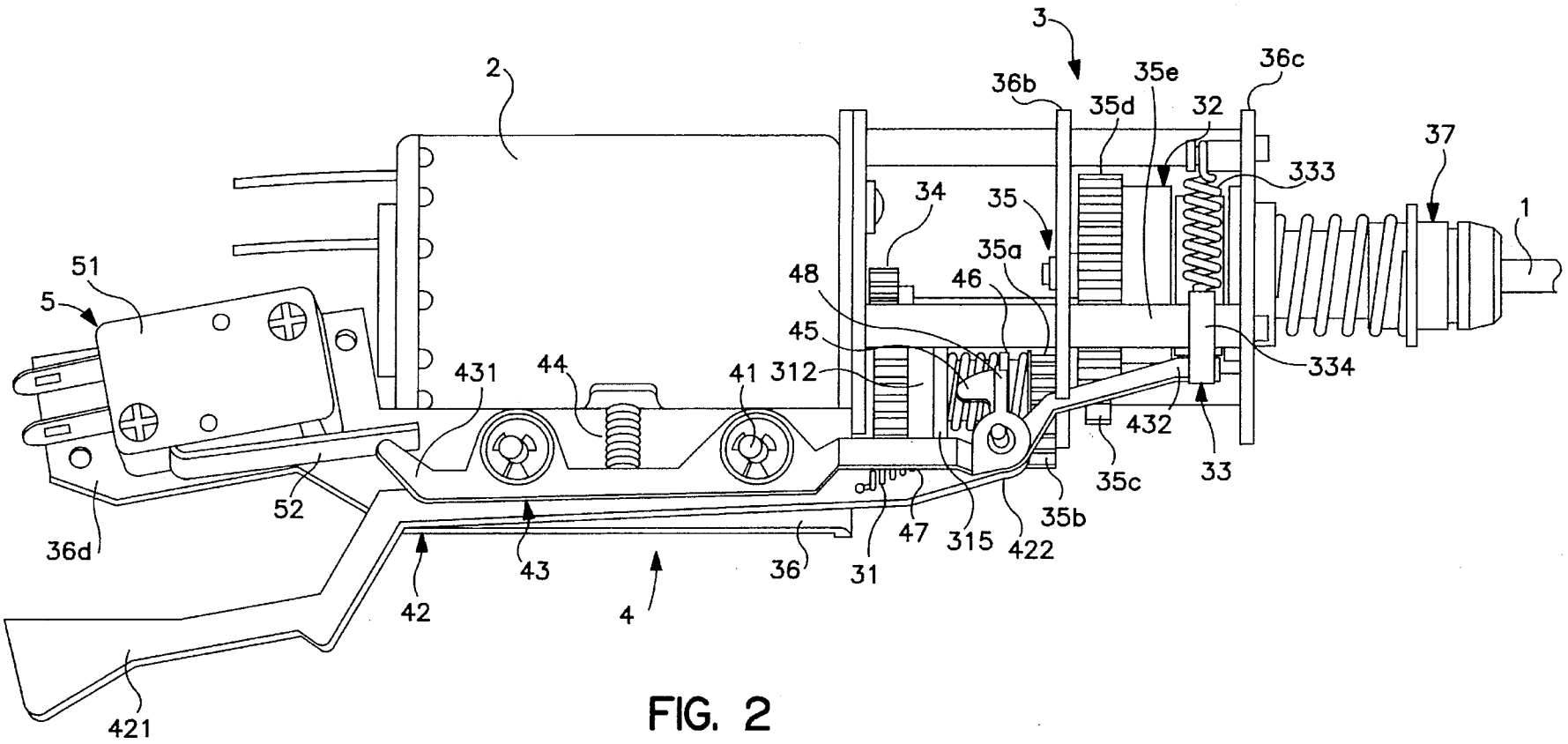
FIG. 2 is a side view of essential parts of a twisted wire bundling machine in which an embodiment of the invention is applied.

As shown in FIG. 2, a twisted wire bundling machine to which an embodiment of the invention is applied comprises a bit 1 which rotates in engagement with a twisted wire W, a motor 2, and a transmission mechanism 3 for cooperation of the bit 1 with the motor 2. The transmission mechanism 3 comprises a torque limiter main body 31, a one-way clutch 32, and a positioning mechanism 33 for defining the stopping position of the bit 1, that is, the rotational phase when stopping, and an operation mechanism 4 for canceling the positioning function of the positioning mechanism 33 is also provided.

Figure 3A:
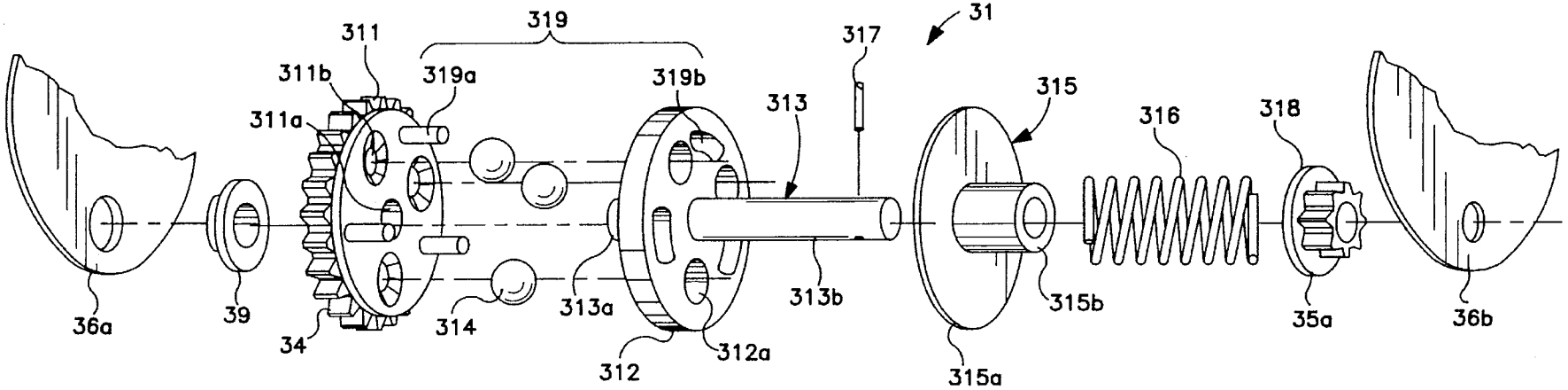
FIG. 3*a*–3*c* show explanatory diagrams of a torque limiter main body in the embodiment of the invention, including FIG. 3*a*, a perspective exploded view, FIG. 3*b*, a sectional view in torque transmission, and FIG. 3*c*, a sectional view in torque cut-off.
Figure 3C:
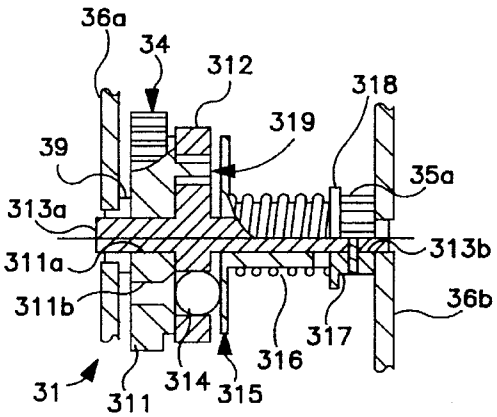
Figure 3B:
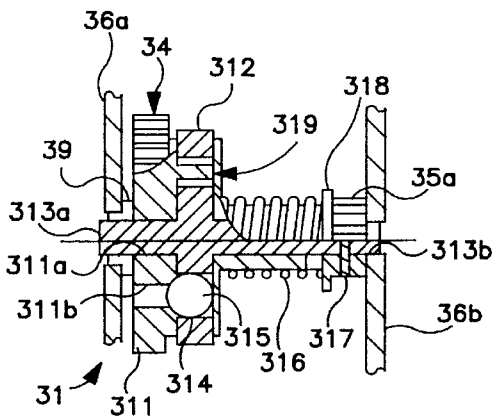

The torque limiter main body 31 possesses a rotary plate 311 as an input member to be coupled with the motor 2 through a reduction gear mechanism 34 as shown in FIG. 3. A central hole 311*a* is formed in the rotary plate 311, and at one side opposite to the motor 2, three ball receiving holes 311*b* are formed at a specific distance from the center of the rotary shaft and at equal intervals in the peripheral direction.

The torque limiter main body 31 possesses a ball holding plate 312 disposed rotatably coaxially confronting the side of the rotary plate 311, and three ball holding holes 312*a* are formed in the ball holding plate 312 at a specific distance from the center of the rotary shaft corresponding to the ball receiving holes 311*b*, at equal intervals in the peripheral direction. In the ball holding plate 312, an output shaft 313 is fixed as an output member penetrating through its axial center or being formed integrally, and the output shaft 313 comprises a shorter end 313*a* projecting from the ball holding plate 312 to the rotary plate 311 side, and a longer end 313*b* projecting from the ball holding plate 312 to the opposite side of the rotary plate 311, and the shorter end 312*a* is rotatably fitted into the central hole 311*a* of the rotary plate 311, and is further supported rotatably in an inner end plate frame 36*a* of a frame 36 through a bush 39.

In the ball holding holes 312*a*, three balls 314 are inserted movably in the rotary shaft central direction of the ball holding plate 312, and these balls are pressed against the rotary plate 311 by a spring 316, so as to be free to move in and out in the rotary shaft central direction of the ball holding plate 312 in the longer end 313*b* at the opposite side of the rotary plate 311 of the ball holding plate 312, and through a holding plate 315 internally fitted rotatably about the rotary shaft center of the ball holding plate 312.

Figure 4:
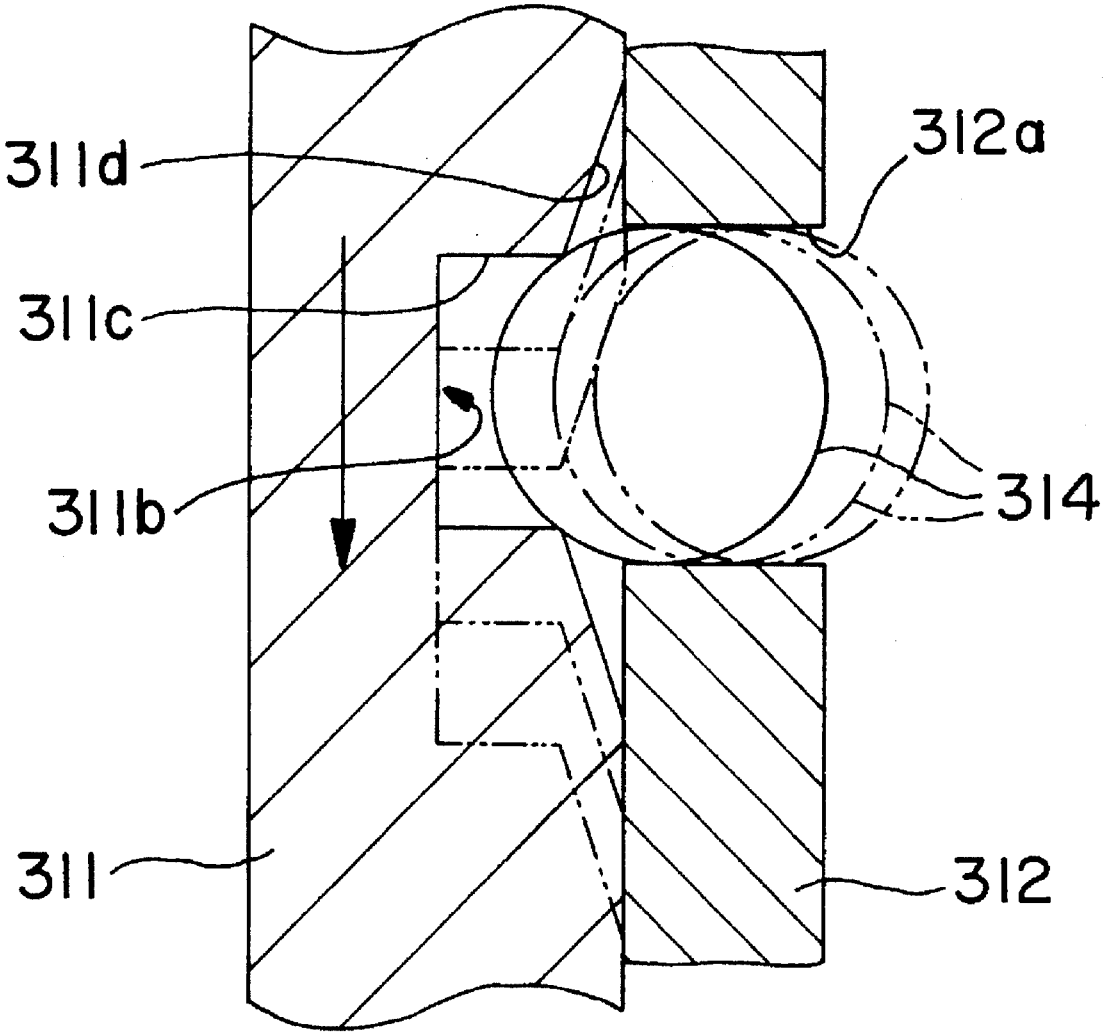
FIG. 4 is a sectional view of a ball receiving hole in the embodiment of the invention.
Figures 5A, 5B:
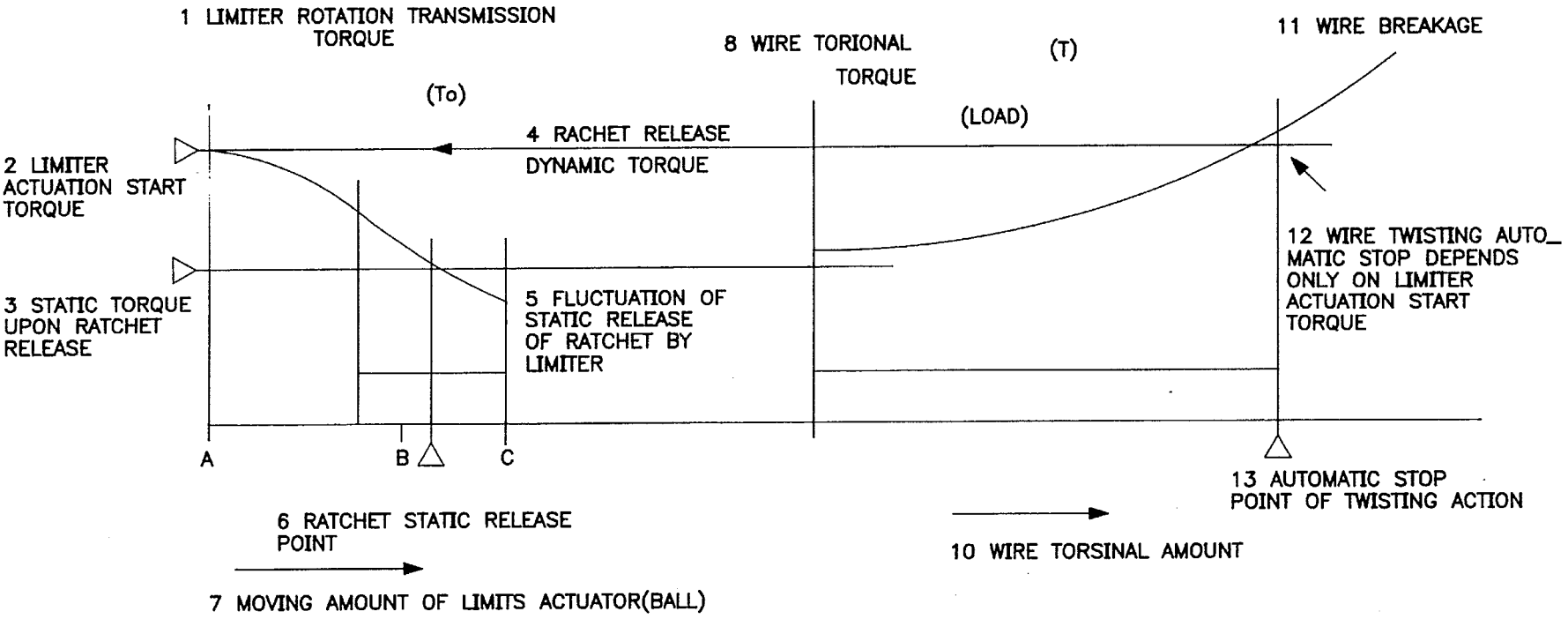
FIGS. 5*a* and 5*b* show characteristic diagrams of the embodiment of the invention, including FIG. 5*a*, a transmission torque diagram, and FIG. 5*b*, a twisted wire torsional torque diagram.
Figure 15:
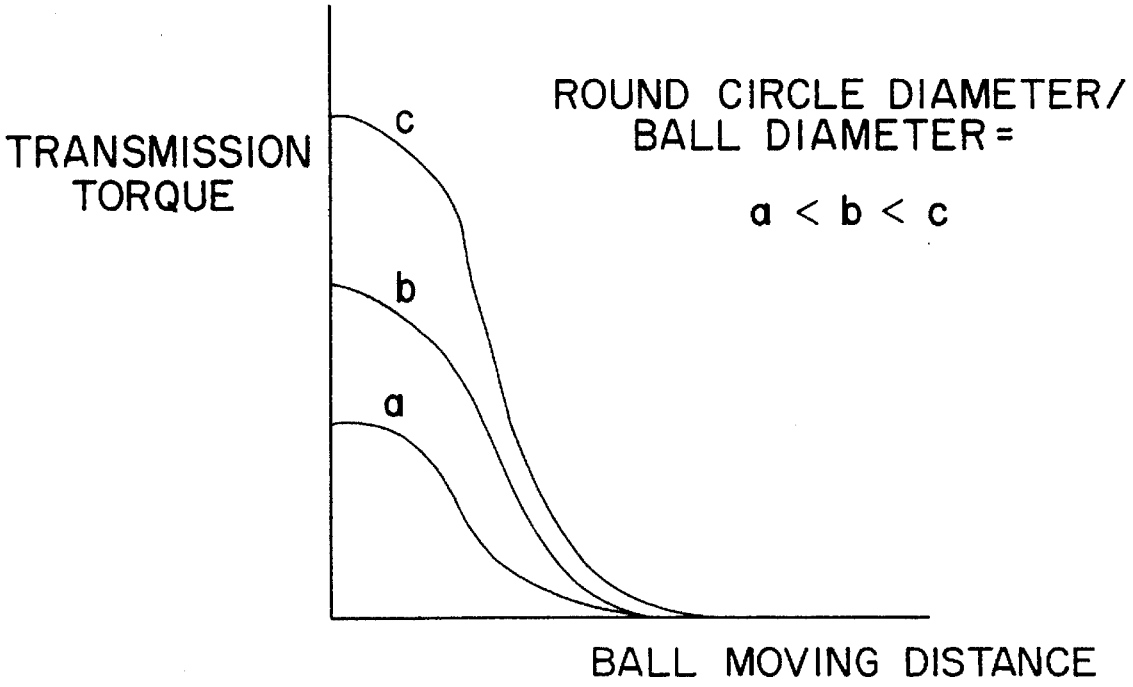
FIG. 15 is a graph showing the relation between the transmission torque and the ball moving distance.

As shown in FIG. 4, the ball receiving holes 311*b* formed in the rotary plate 311 are composed of circular holes 311*c* of a smaller diameter than the balls 314, and flat holes 311*d* consecutive thereto, being extended in diameter as approaching the surface of the rotary plate 311 and becoming larger in diameter than the ball 314 on the surface of the rotary plate 311. As a result, as shown in FIG. 5, the transmission torque reaches the maximum when the balls 314 begin to move, and the twisted wire torsional torque is determined only by the transmission torque when the balls 314 begin to move. The transmission torque when the balls 314 move is determined by a ratio of the diameter of balls 314 and the diameter of the circular holes 311*c*, and the pressure of the spring 316 as shown in FIG. 15.

For example, when the pressure of the spring 316 is the same, the initial transmission torque increases since the ball diameter is larger than the diameter of the circular holes 311*c*, and then decreases suddenly thereafter.

As a matter of course, when the pressure of the spring 316 is increased, the transmission torque becomes larger. In design, the size of the circular hole 311*c* is set to about half of the diameter of balls 314, or less, the spring pressure is adjusted, and the initial transmission torque is adjusted, which is advantageous structurally. The flat holes 311*d* are not needed in principle, but in this embodiment, the stroke for actuating a lever 45 described later is kept by the taper of the flat holes 311*d*.

Herein, as shown in FIG. 3, the holding plate 315 comprises a disk plate 315*a* possessing a round hole in the center, and a tube 315*b* for smoothly moving in and out the ball holding plate 312 relative to the plate 315*a* in the rotary shaft central direction. The spring 316 is disposed concentrically with the front end of the longer end 313*b*, between a spring washer 318 prevented from getting out of the longer end 313*b* by a pin 317 inserted into the front end of the longer end 313*b* and the plate 315*a* of the holding plate 315. A pinion 35*a* of a second reduction gear mechanism 35 mentioned later is integrally formed on the spring washer 318.

The torque limiter main body 31 is furnished with rotation limiting means 319 for limiting the relative rotation of the rotary plate 311 and ball holding plate 312 below a specific angle. The rotation limiting means 319 comprises three limiting pins 319*a* projecting from the rotary plate 311 toward the ball holding plate 312 side, and three arc-shaped holes formed in the ball forming plate 312 in which the rotation limiting pins are inserted movably within a specific angle in the peripheral direction, and after the torque transmission from the rotary plate 311 to the ball holding plate 312 is cut off by the torque limiting action of the torque limiter main body 31, by rotating the rotary plate 311 more than a specific angle by the motor 2, the ball holding plate 312 can be rotated in cooperation with the rotation of the rotary plate 311.

As shown in FIG. 2, the second reduction gear mechanism 35 interposed between the torque limiter main body 31 and one-way clutch 32 is rotatably supported on the pinion 35*a* and middle plate frame 36*b*, and comprises a middle gear 35*b* to be engaged with the pinion 35*a*, a middle pinion 35*c* fixed on the middle gear 35*b*, and a final gear 35*d* to be engaged with the middle pinion 35*c*.

Figure 6:
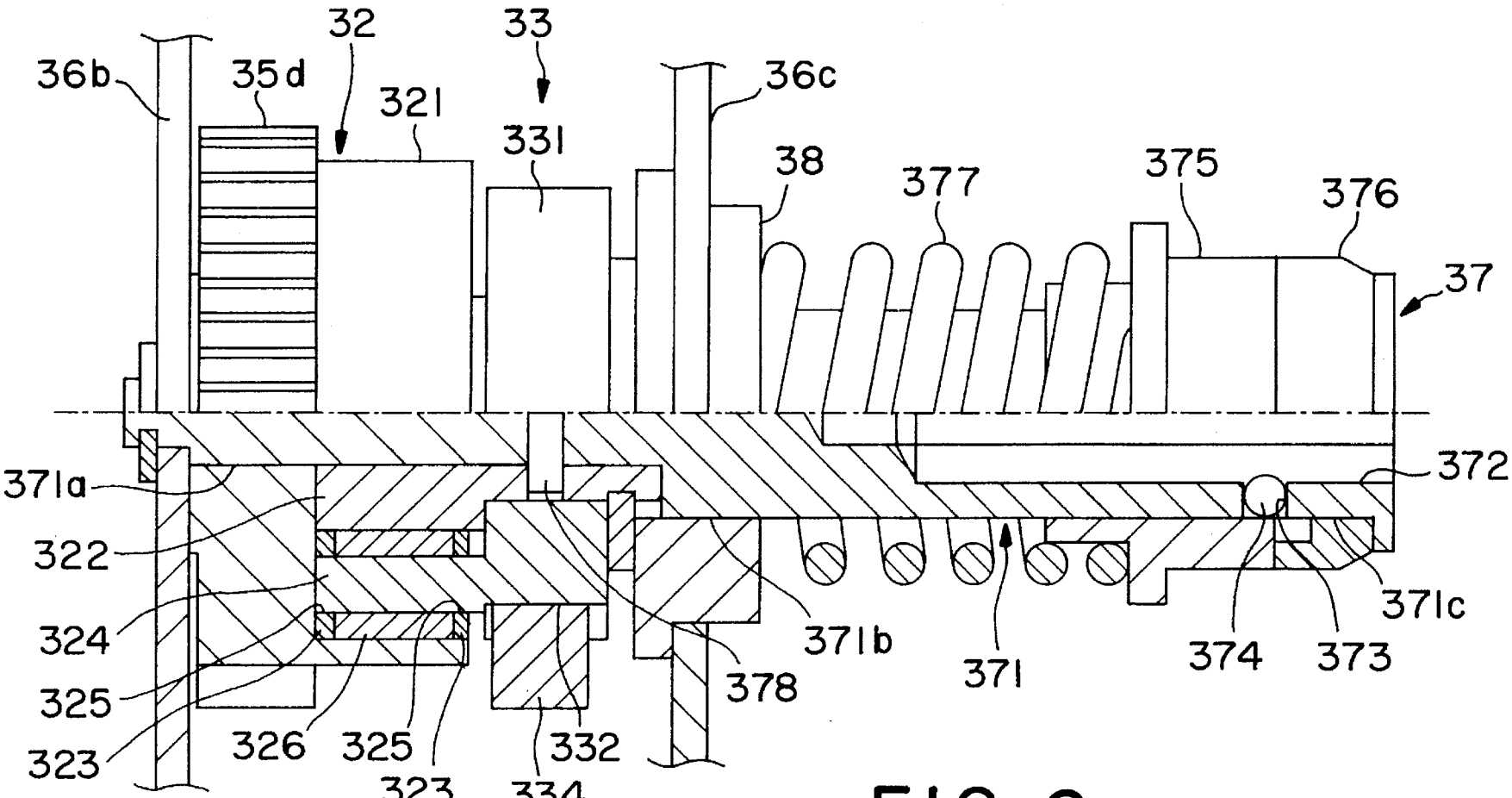
FIG. 6 is a semi-sectional view of a one-way clutch and positioning mechanism in the embodiment of the invention.
Figure 7A:
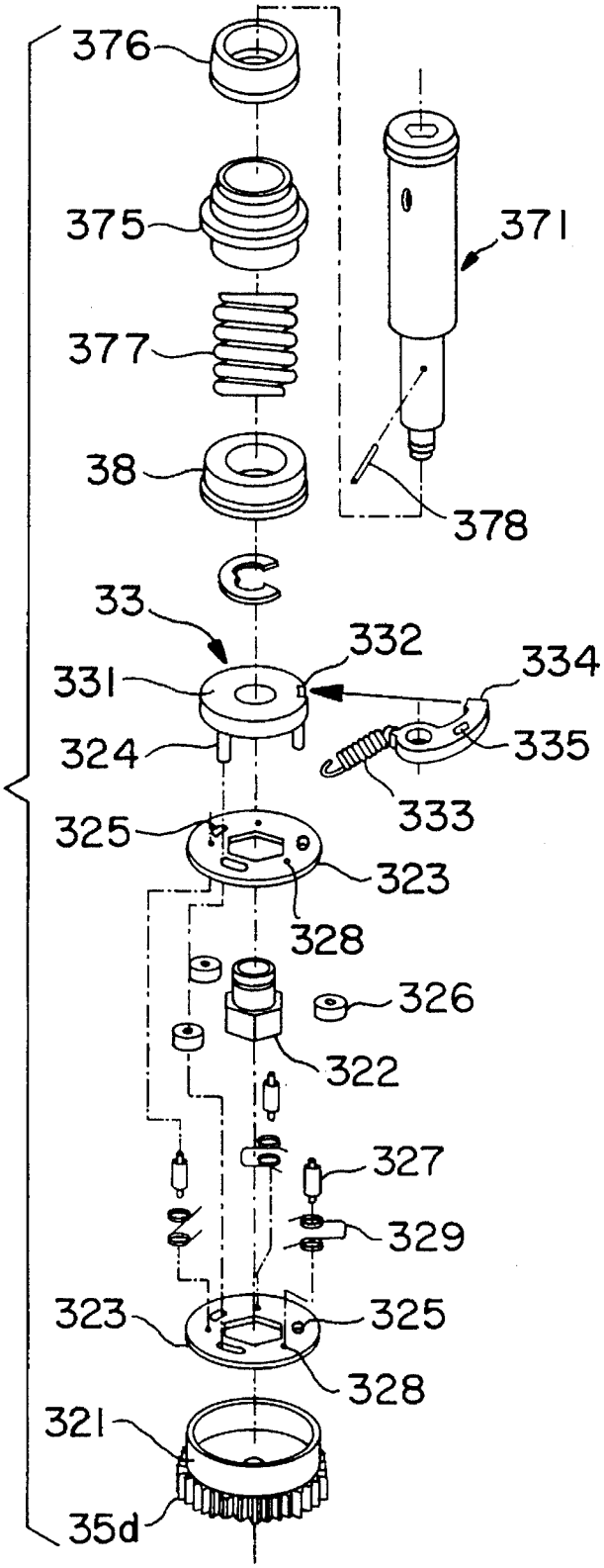
FIGS. 7*a*–7*c* show explanatory diagrams of one-way clutch and positioning mechanism in the embodiment of the invention, including FIG. 7*a*, a perspective exploded view, FIG. 7*b*, a front view in transmission mode of one-way clutch, and FIG. 7*c*, a front view in cut-off mode of a one-way clutch.
Figure 7B:
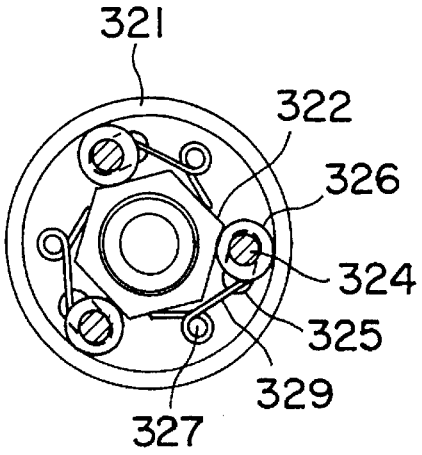
Figure 7C:
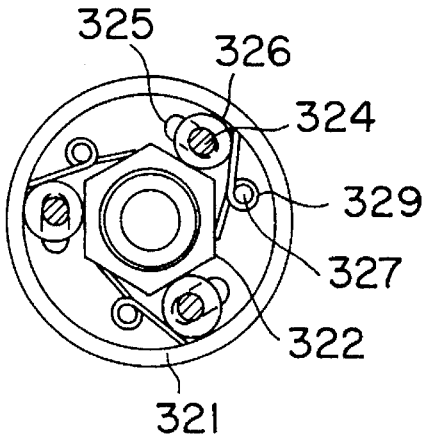

As shown in FIG. 6 and FIG. 7, the one-way clutch 32 has an outer ring 321 formed integrally with the final gear 35*d* of the reduction gear mechanism 35, and a hexagon shaft 322 coaxially rotatably inserted in the outer ring 321, and a pair of roller support plates 323 are fixed on the hexagon shaft 322 at a proper interval in the shaft central direction, and arc-shaped holes 325 are formed on both roller support plates 323 at equal intervals in the peripheral direction, in which both ends of three roller shafts 324 are inserted movably parallel in the peripheral direction. On each roller shaft 324, between both roller support plates 323, a clutch roller 326 with a diameter smaller than the maximum interval of the outer ring 321 and hexagon shaft 322 and larger than the minimum interval is rotatably fitted externally. Between the arc-shaped holes 325 of each roller support plate 323, a round hole 328 for internally fitting the both ends of the spring support shaft 327 is formed, and by a helical spring 329 held through the spring support shaft 327 on both roller support plates 323, each clutch roller 325 is individually pressed to the outer circumference of the hexagon shaft 322.

Figure 8A:
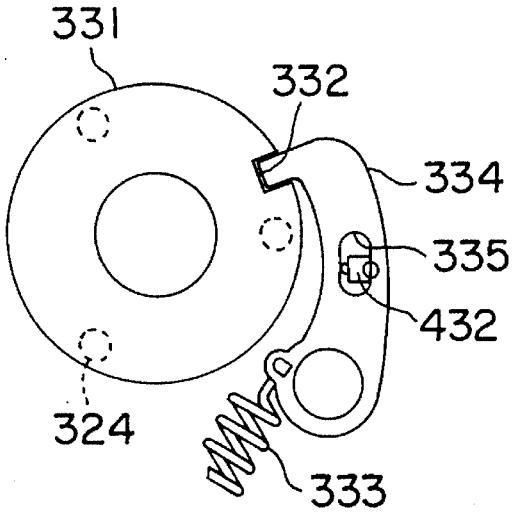
FIGS. 8 and 8*b* show explanatory diagrams of a positioning mechanism in the embodiment of the invention, including FIG. 8*a*, a front view in a positioning mode, and FIG. 8*b*, a front view in a clearing mode.
Figure 8B:
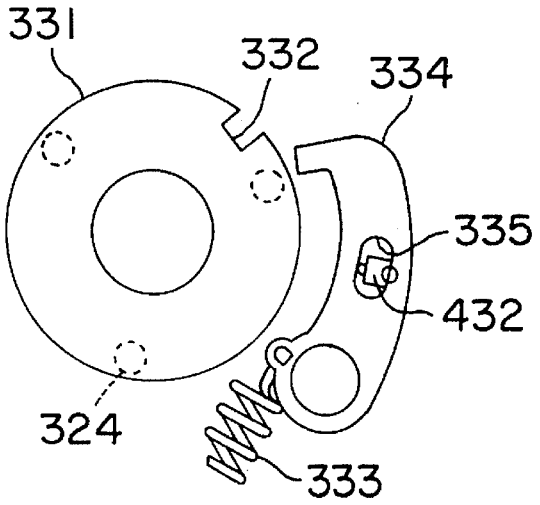

The positioning mechanism 33 has a rotary plate 331 disposed on the hexagon shaft 322 of the one-way clutch 32 so as to be coaxially rotatable within a specified range, and this rotary plate 331 is integrally formed with each roller shaft 324 of the one-way clutch 32 as shown in FIG. 6, FIG. 7 or FIG. 8, and a groove 332 for positioning is formed at one point on the outer circumference.

Besides, the positioning mechanism 33 is oscillatably supported on a coupling shaft frame 36*e* of the frame 36 shown in FIG. 2, and has a pawl 334 which is pressed to the outer circumference of the rotary plate 331 by a spring 333. As shown in FIG. 6, a central shaft 371 of a chuck device 37 is penetrating through the outer ring 321 and hexagon shaft 322 of the one-way clutch 32 and rotary plate 331 of the positioning mechanism 33, and the central shaft 371 is rotatably fitted in the outer ring 321, and is fixed on the hexagon shaft 322 by a pin 378. One end 371*a* of the central shaft 371 is rotatably fitted in the middle plate frame 36*b* of the frame 36, and the middle part is rotatably supported on a front end plate frame 36*c* of the frame 36 of the transmission mechanism 3 through a bush 38.

Figure 9:
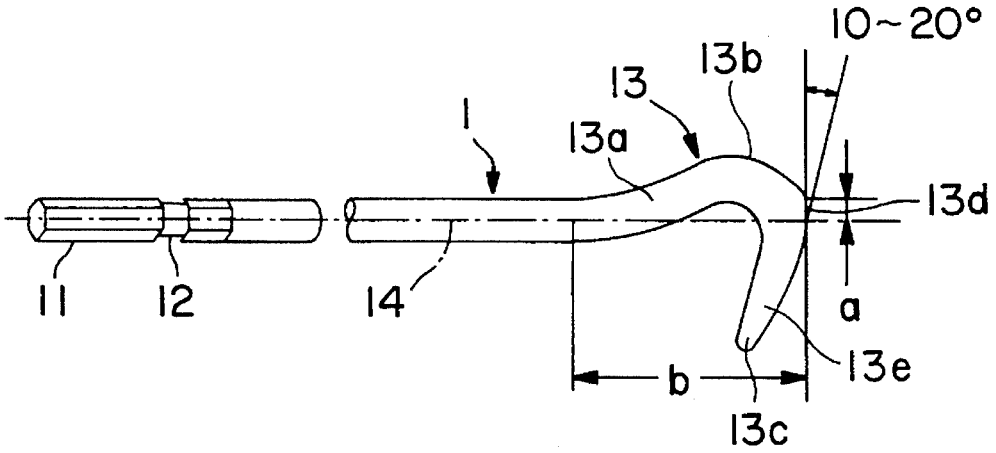
FIG. 9 is a side view of a bit of a twisted wire bundling machine in which the embodiment of the invention is applied.

A hexagon hole 372 is formed at the other end 371*c* of the central shaft 371, and, as shown in FIG. 9, a hexagon shaft 11 corresponding to the hexagon hole 372 is formed at the base end part of the bit 1. Therefore, when inserting the hexagon shaft 11 into the hexagon hole 372, the mounting angle about the axial center of the bit 1 can be varied in every 60 degrees. Moreover, as shown in FIG. 6 or FIG. 7, a ball holding hole 373 communicating with the hexagon hole 372 is formed at the other end 371*c* of the central shaft 371, and a peripheral groove 12 is formed in the portion corresponding to the ball holding hole 373 of the bit 1, that is, in the intermediate part of the hexagon shaft 11. Further, as shown in FIG. 6, a ball 374 for positioning is freely inserted in the ball holding hole 373, while a sleeve 375 is slidably mounted outside the central shaft 371.

When the sleeve 375 moves to the chucking position of the other end 371*c* side of the central shaft 371, by covering the ball holding hole 373 with the sleeve 375, a part of the ball 374 is pushed into the peripheral groove 12 of the hexagon shaft 11 inserted in the hexagon hole 372 by pushing the ball 374 with the sleeve 375, and when the sleeve 375 is moved to the unchucking position at one end 371*a* side of the central shaft 371, the sleeve 375 opens the ball holding hole 374, so that the ball 374 may be free to go in and out of the ball holding hole 373.

A cap 376 is fixed to the outside of the other end 371*c* of the central shaft 371, and by receiving the other end of the sleeve 375 by this cap 376, the sleeve 375 is limited from moving to the other end 371*c* side of the central shaft 371 from the chucking position, and the sleeve 375 is thrust at the chucking position by the spring 377 disposed to set the central shaft 371 around the bush 38 and sleeve 375.

Figure 10A:
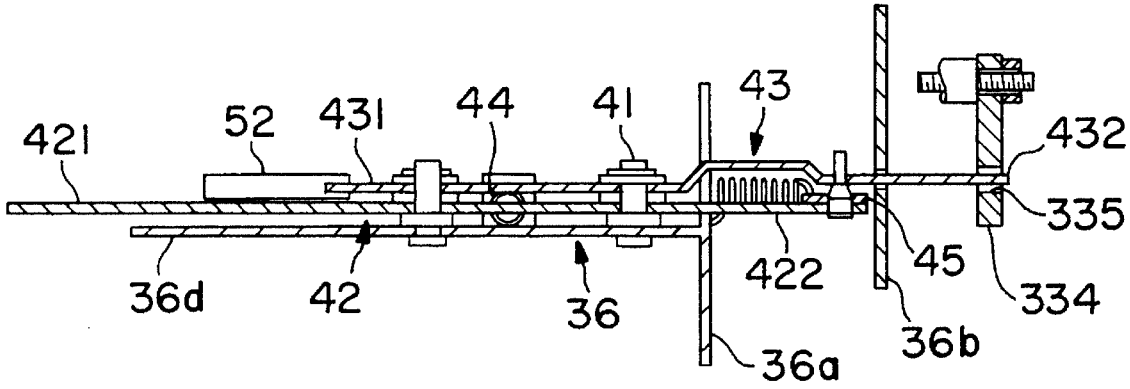
FIGS. 10*a* and 10*b* show explanatory diagrams of an operation mechanism in the embodiment of the invention, including FIG. 10*a*, a cross sectional bottom view and FIG. 10*b*, a perspective exploded view.
Figure 10B:
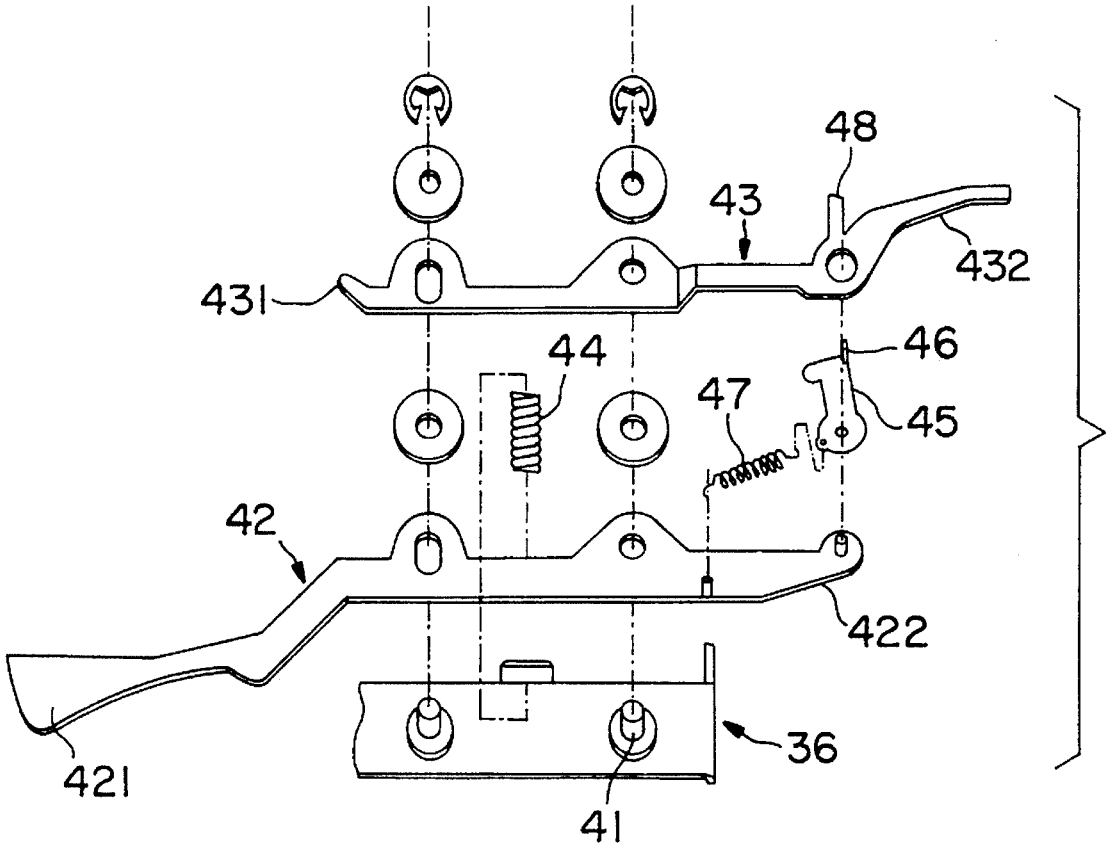

The operating mechanism 4 comprises an operation lever 42 and a floating lever 43 disposed oscillatably about a fulcrum pin 41 fixed on the frame 36 as shown in FIG. 2 and FIG. 10.

This operation lever 42 possesses an operation arm 421 extended to the outer side of one end of the motor 2 from the fulcrum pin 41, and an action arm 422 extended nearly to the torque limiter main body 31 at the other end from the fulcrum pin 41, so as to be thrust in the operation canceling direction (the departing direction of the operation arm 421 from the motor 2) by a spring 44 mounted between the middle part of the operation arm 421 and the frame 36. At the front end of the action arm 422, a pin lever 45 is oscillated and driven by the main body 315*a* of the holding plate 315 of the torque limiter main body 31 is pivoted, and a pin 46 projecting to the floating lever 43 side is connected to the free end of the lever pin 45, and the free end of the pin lever 45 is pressed to the main body 315*a* of the holding plate 315 by a spring 47 mounted between the pin lever 45 and operation lever 42.

The floating lever 43 comprises a switch operation arm 431 extended outward from the fulcrum pin 41 to one end of the motor 2, and an action arm 432 extended-from the fulcrum pin 41 to the positioning mechanism 33, and the front end of the action arm 432 is pushed into an engagement hole 335 formed in the pawl 334 of the positioning mechanism 33. The action arm 432 of the floating lever 43 is provided with a pin receiving part 48 for connecting and disconnecting a pin 46 of the pin lever 45.

Figure 11A:
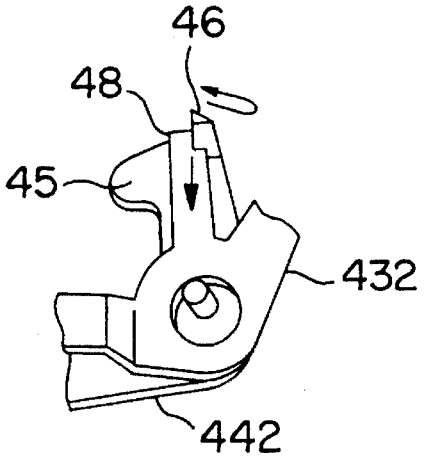
FIG. 11*a* and 11*b* show explanatory diagrams of a pin lever in the embodiment of the invention, including FIG. 11*a*, a side view in a pin engagement state and FIG. 11*b*, a side view in a pin disengagement state.
Figure 11B:
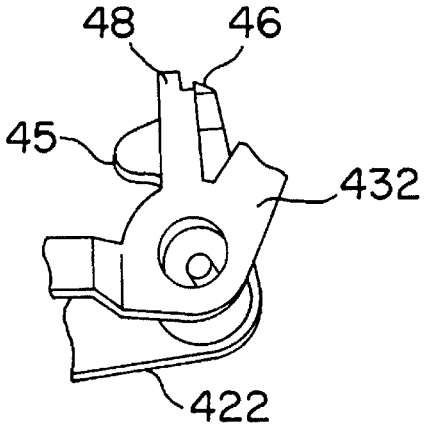

As shown in FIG. 11(*a*), with the pin 46 engaged in the pin receiving part 48, when the operation lever 42 is manipulated in the operation direction (the direction of moving the operation arm 421 closer to the motor 2), the floating lever 43 cooperates with the operation lever 42 to turn on the switch 5 (see FIG. 2) for running the motor 2, while the pawl 334 of the positioning mechanism 33 is dislocated from the groove 332 by resisting the spring 333, and the driving force of the motor 2 is transmitted to the bit 1 through the transmission mechanism 3, thereby stranding the twisted wire W. Afterwards, as the stranding of the twisted wire W is advanced and the twisted wire torsional torque acting on the torque limiter main body 31 from the bit 1 exceeds the torque limit value, the holding plate 315 of the torque limiter main body 31 drives the pin lever 45, and the pin 46 of the pin lever 45 is dislocated from the pin receiving pat 48 of the floating lever 43 as shown in FIG. 11(*b*). By the spring 333 of the positioning mechanism 33, the pawl 334 is elastically pressed to the outer circumference of the rotary plate 331, and the floating lever 43 cooperating with the pawl 334 turns off the switch for running the motor 2 when the pawl 334 fits into the groove 332.

At the position where the pawl 334 is not fitted into the groove 332, when the pin 45 of the pin lever 45 is dislocated from the pin receiving part 48 of the floating lever 43, the floating lever 43 cooperating with the pin 334 is located at the same position where the pin 46 is dislocated from the pin receiving part 48, and the switch for operating the motor 2 is not turned off. Therefore, even after torque limiting by the torque limiter main body 31 is started, the rotation of the motor 2 continues, and the rotary plate 331 of the torque limiter 31 continues to rotate on the ball holding plate 312 which has been stopped by the twisted wire torsional torque. When the rotation of the rotary plate 331 to the ball holding plate 312 exceeds a specific angle, the rotary plate 331 drives the ball holding plate 312 by the action of the rotation limiting means 319, so that the rotary plate 331 of the positioning mechanism 33 rotates. When the groove 332 of the rotary plate 331 rotates to a position confronting the pawl 334, the pawl 334 fits into the groove 332, and in cooperation with the pawl 334, the floating lever 42 turns off the switch for operating the motor 2, so that the rotation of the motor 2 is stopped.

When the operation lever 42 is released afterwards, the operation lever 42 is driven in the operation canceling direction by the spring 44, and the pin 46 of the pin lever 45 returns to the position to be engaged with the pin receiving part 48 of the floating lever 43.

Besides, as shown in FIG. 2, the switch 5 comprises a main body package 51 fixed to the base part 36*d* of the frame 36 extended to the outer side of one end of the motor 2, and an operation lever 52 drawn out from the main body package.

The operation lever 52 of the switch 5 is designed to turn on the switch 5 by manipulating the operation lever of the operation mechanism 4 in the operating direction as mentioned above to push the operation lever 42 to the switch operation lever 431 of the floating lever 43, and to turn off the switch 5 as being released from the switch operation lever 431 of the floating switch 43 when the pawl 334 of the positioning mechanism 33 is fitted into the groove 332 after start of the motor 2.

At the front end of the bit 1, a hook 13 is formed as shown in FIG. 9. The hook 13 comprises a slope 13*a* inclining to one side from the position at a specific distance from the front end, a curve 13*b* bending to the axial center of the bit 1 continuously from the slope 13*a*, and a tip 13*c* extending from the axial center 14 of the bit 1 to the opposite direction of the slope 13*a* and bending moderately to the base end direction of the bit 1, and and the front end side 13*d* to a specific distance a from the bit axial center 14 of the curve 13*b* is inclined by 10° to 20° (about 15° in this example) to the axial center orthogonal to the axial center 14 of the bit 1, being smoothly continuous from the front curved surface 13*e* of the tip 13*c*.

Figure 12:
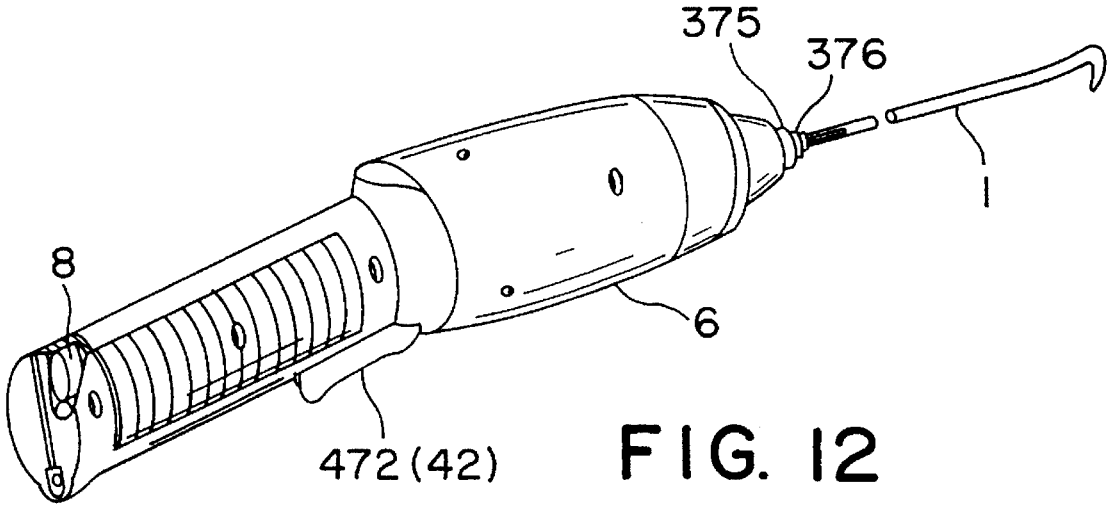
FIG. 12 is a perspective view of an appearance of a twisted wire bundling machine in which the embodiment of the invention is applied.

A shown in FIG. 12, the frame 36, motor 2, transmission mechanism 3, and operation mechanism 4 are accommodated in the main body case 6, except for the operation lever 41 of the operation mechanism 4, one end of the frame 36, and cap 376 and sleeve 375 of the transmission mechanism 3, and the base end part of the operation leer 41 of the operation mechanism 4 and one end of the frame 36 are accommodated in the grip case 7 consecutively disposed as one end side of the main body case 6, together with the dry battery as power source and wiring.

Figure 13:
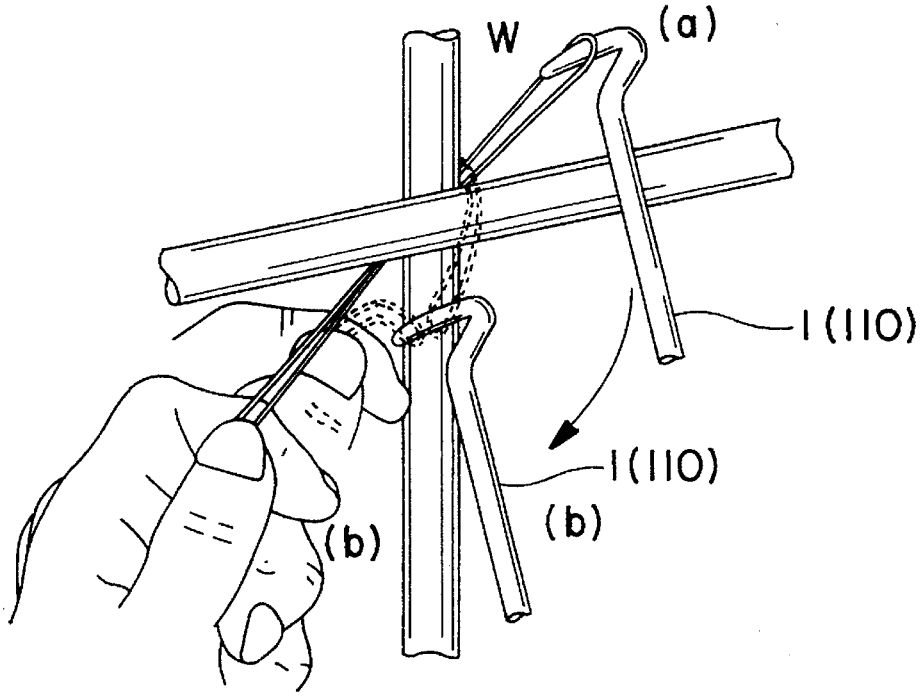
FIG. 13 is an explanatory diagram of a twisted wire entangling job.

Holding the grip case 7 by one hand, as shown in FIG. 13, (a) the hook 13 of the bit 1 is inserted into the folding part of the twisted wire W folded in a U form, and (b) the hook 13 of the bit 1 is applied on double wire of the twisted wire W held by the other hand at the end of the twisted wire W, and thereby by twisting the twisted wire bundling machine a turn by hand, the twisted wire W is entangled on the hook 13 of the bit 1.

Thus, in the twisted wire bundling machine, since the previous twisted wire bundling job is finished in the state of the bit 1 being positioned in the fitting position of the pawl 334 into the groove 332 formed on the periphery of the rotary plate 331 of the positioning mechanism 33, idling of the bit 1 does not occur when twisting the twisted wire bundling machine by hand in order to entangle the twisted wire W, and therefore the twisted wire W can be securely entangled on the bit 1 only by twisting the twisted wire bundling machine once by hand, so that the working efficiency may be enhanced.

Figure 14:
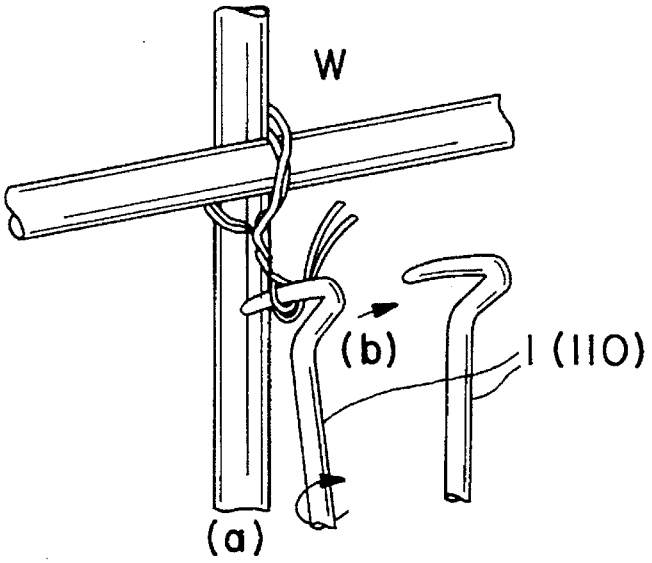
FIG. 14 is an explanatory diagram of a twisted wire stranding job.

In this way, after entangling the twisted wire W on the hook 13 of the bit 1, when the operation arm 421 of the operation lever 42 of the operation mechanism 4 is gripped and tightened together with the grip case 7, the positioning action of the positioning mechanism is released, and the motor 2 rotates and, as shown in FIG. 14, (a) the bit 1 rotates, and the twisted wire W is entangled. When the twisted wire torsional torque increases more than a specific value, the bit 1 is positioned in a specific rotation phase by the torque limiter main body 1 and positioning mechanism 33, and the floating lever 43 is driven by the spring 333 of the positioning mechanism 33 through the pawl 334 to turn off the switch 5, so that the motor 2 is stopped. Later, (b) by moving the bit 1 in the opposite direction of the inserting direction, the hook 13 is easily pulled out of the twisted wire W.

Figure 16:
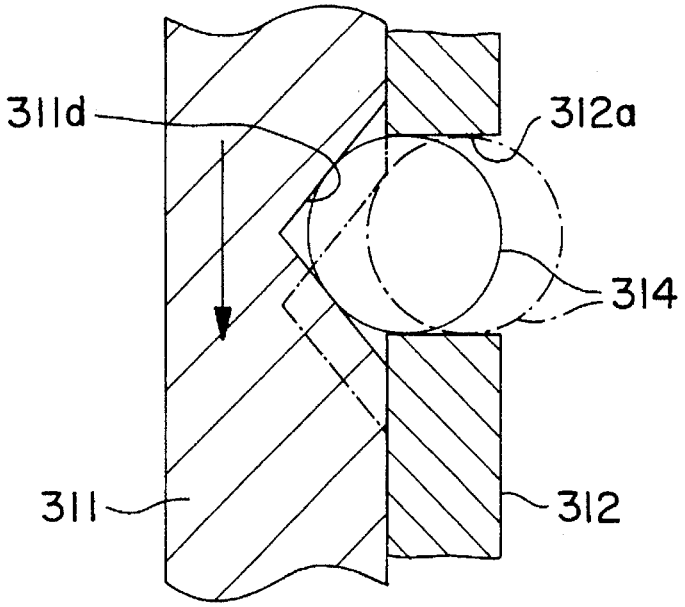
FIG. 16 is a sectional view-of a ball receiving hole in another embodiment of the invention.

In this embodiment of the positioning mechanism, the ball receiving hole 311*b* of the torque limiter 31 is composed of round hole 311*c* and flat hole 311*d*, but instead, as shown in FIG. 16, a simple conical ball receiving hole 311*b* may be formed, or, a shake-proof washer used hitherto may be formed instead of the ball receiving hole 311*b*.

Figures 17A, 17B:
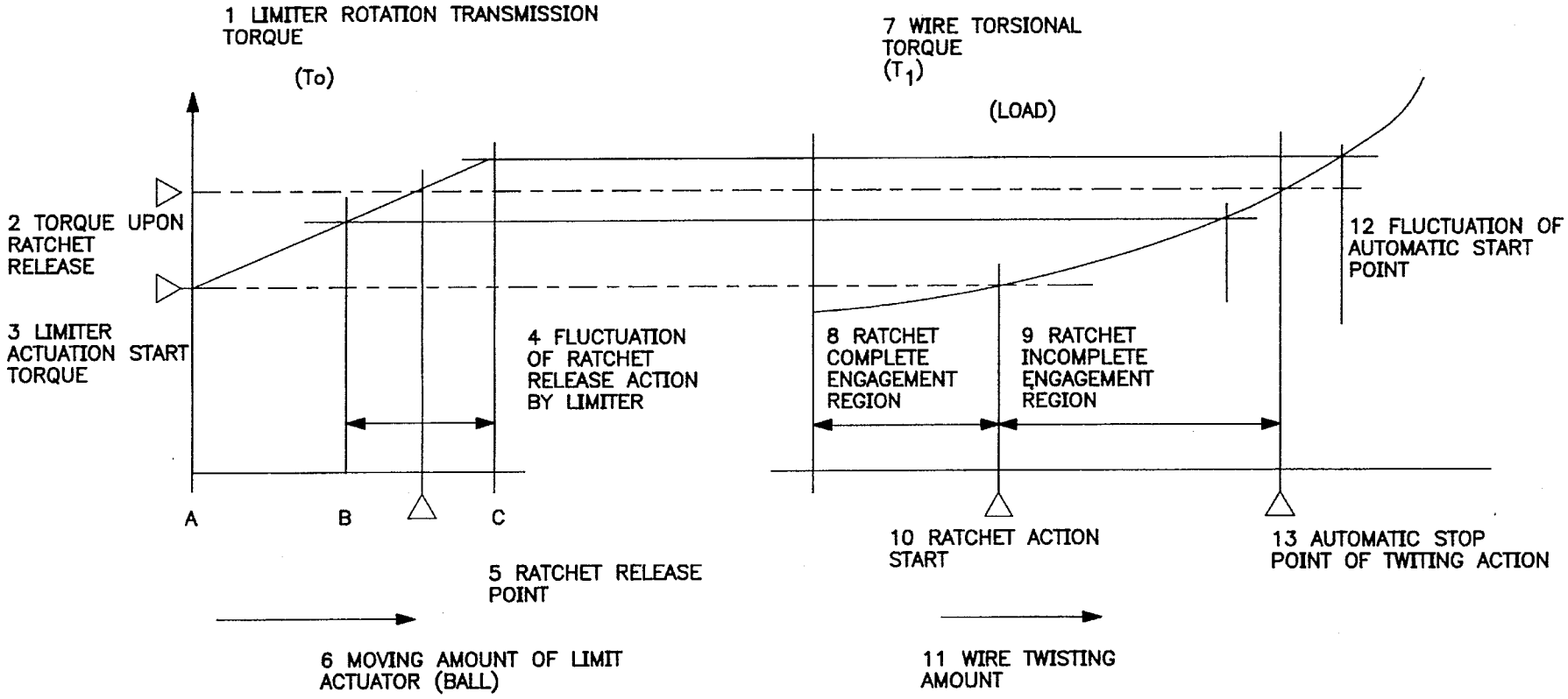
FIG. 17*a* and 17*b* shows characteristic diagrams in the other embodiment of the invention, including FIG. 17*a*, a transmission torque diagram and FIG. 17*b*, a twisted wire torsional torque diagram.
Figure 18A:
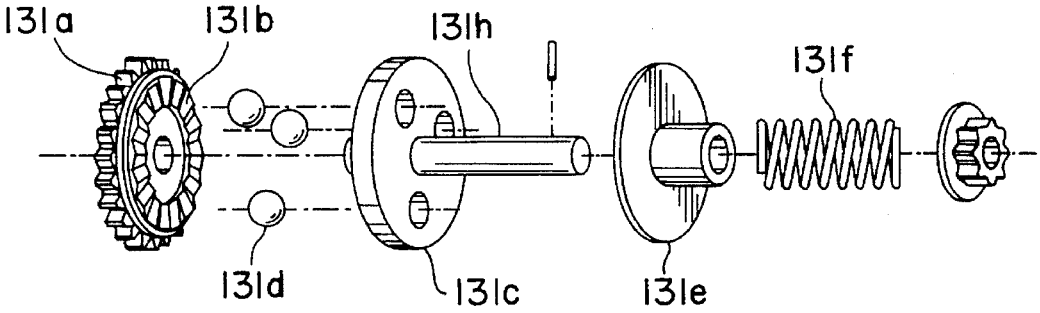
FIG. 18a PRIOR ART
FIG. 18*a*–18*c* shows explanatory diagrams of a conventional torque limiter, including FIG. 18*a*, a perspective exploded view, FIG. 18*b*, a sectional view in a torque transmission, and FIG. 18*c*, a sectional view in a torque cut-off.
Figure 18B:
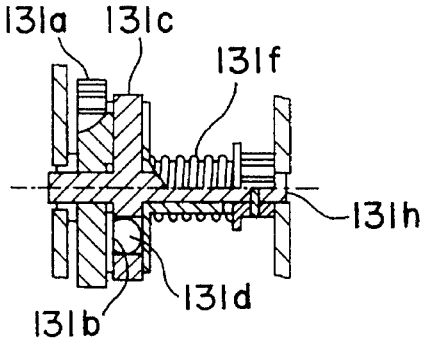
FIG. 18b PRIOR ART
Figure 18C:
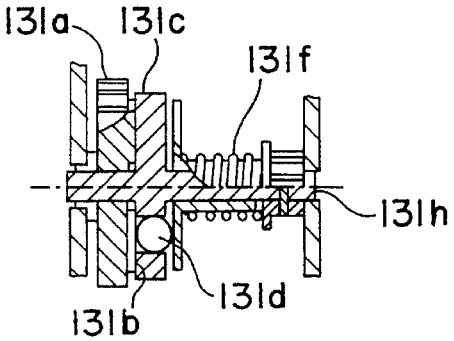
FIG. 18c PRIOR ART
Figure 19A:
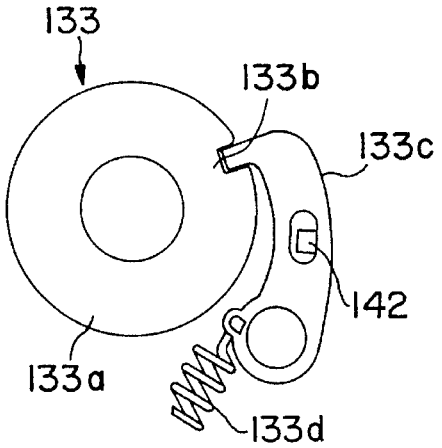
FIG. 19a PRIOR ART
FIGS. 19*a* and 19*b* show explanatory diagrams of a conventional positioning mechanism, including FIG. 19*a*, a front view in a positioning situation 19*b*, a front view in a clearing situation.
Figure 19B:
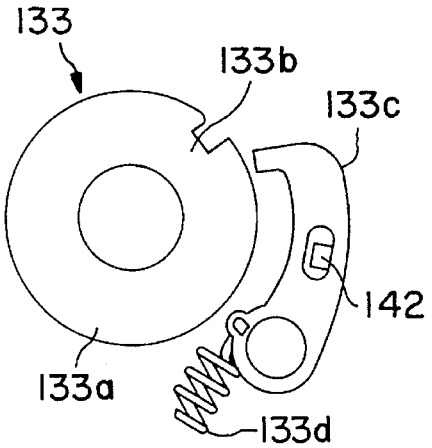
FIG. 19b PRIOR ART

In this case, the relation of the transmission torque and the moving distance of the ball 314 in the axial central direction of the rotary plate 311 is, as shown in FIG. 17(*a*), in the relation of increasing the transmission torque in proportion as the moving extent of the ball 314 increases, and the twisted wire torsional torque is determined depending on the transmission torque upon the ratchet releasing point where the ball 314 rides on the surface of the rotary plate 311.

However, when the ball receiving hole 311*b* is formed in a simple conical form, the machining size of the ball receiving hole 311*b* tends to fluctuate, and hence the twisted wire torsional torque is likely to vary, and therefore, as shown in the embodiment, it is recommended that the ball receiving hole 311*b* be composed of a round hole 311*c* smaller in diameter than the ball 314, and a flat hole 311*d* which is extended toward the surface of the rotary plate 311 consecutively thereto, and is larger in diameter than the ball 314 on the surface of the rotary plate 331.

Finally, the invention is applied not only in the torque limiter of twisted wire bundling machine, but may be widely used in the torque limiters where stable operation and specific stopping position are required.

I claim:

1. A torque limiter comprising an input member for providing a driving force, an output member including a shaft which rotates in cooperation with the input member and receives a load, and a torque limiter main body between the input member and the output member for cutting off torque transmission when the load torque exceeds a specific value, said torque limiter body including a rotary plate (311) comprising ball receiving holes (311*b*) equally disposed about a central hole (311*a*), each of said ball receiving holes comprising a cylindrical portion having a diameter smaller than a diameter of a ball to be received and a countersink portion that continues from the cylindrical portion outwardly to a surface of said rotary plate, said countersink portion has a diameter that increases as the ball receiving hole becomes closer to the surface of said rotary plate such that the countersink at the surface of the plate is larger than the diameter of the ball, a ball holding plate (312) juxtaposed said rotary plate, said ball holding plate having a thickness less than a diameter of the ball and including ball receiving holes that correspond with said ball receiving holes in said rotary plate, each of said ball receiving holes in said ball. holding plate having a diameter which is slightly larger than the diameter of the balls, and a ball pressing mechanism including a holding plate (315) juxtaposed said ball holding plate which seats upon said balls in said ball receiving holes in said ball holding plate, and a spring which is provided for pressing upon said holding plate which presses said balls into said circular holes in said rotary plate having a smaller diameter than the balls.

2. A torque limiter as set forth in claim 1, further comprising:

rotation limiting means for limiting a relative rotational angle of the input member and output member within a specific angle after actuation of the torque limiter main body, a detector means positioned relative to said torque limiter main body for detecting the action of the torque limiter main body and transmitting rotary motion to the output member, and a positioning mechanism for receiving the action result of the torque limiter main body detected by the detecting means, and positioning said torque limiter main body relative to the output means.

3. A torque limiter as claimed in claim 2, wherein rotation limiting means comprises:

rotating limiting pins extending from the input member, and said ball holding plate rotates in cooperation with the output member, said ball holding plate holds said balls on the input member, and has plural arc-shaped holes in which the rotation limiting pins are inserted movably within a specific angle in a peripheral direction.

4. A torque limiter as claimed in claim 2, wherein:

said rotary plate is coupled to the output member of the torque limiter main body, said rotary plate includes a positioning groove on the periphery, a pawl that bites into the groove and a spring that presses said pawl onto the peripheral surface of the rotary plate.

5. A torque limiter as claimed in claim 4, comprising a clearing means for disengaging the pawl from the groove by resisting a force of the spring.

6. A torque limiter as claimed in claim 2, which comprises a driving stopping means for stopping the input member when the positioning mechanism is actuated.

7. A torque limiter as set forth in claim 1, in which said output member includes an output shaft (313), said output shaft is integral with said ball holding plate and has a short end that extends from one surface of said ball holding plate through said central hole in said rotary plate and a longer portion that extends from an opposite face of said ball holding plate.

* * * * *